US012416213B2

(12) United States Patent
Caekebeke et al.

(10) Patent No.: US 12,416,213 B2
(45) Date of Patent: Sep. 16, 2025

(54) PRESSURE RELEASE SYSTEM FOR WELL INTERVENTION

(71) Applicant: Schlumberger Technology Corporation, Sugar Land, TX (US)

(72) Inventors: Laurent Caekebeke, Sugar Land, TX (US); Kody Carrillo, Sugar Land, TX (US); Christopher Albert Babin, Waveland, MS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/347,941

(22) Filed: Jul. 6, 2023

(65) Prior Publication Data

US 2025/0012163 A1 Jan. 9, 2025

(51) Int. Cl.

| | |
|---|---|
| ***E21B 33/068*** | (2006.01) |
| ***E21B 23/08*** | (2006.01) |
| ***E21B 33/035*** | (2006.01) |
| ***E21B 41/04*** | (2006.01) |
| ***E21B 47/001*** | (2012.01) |

(52) U.S. Cl.

CPC ..... *E21B 33/0355* (2013.01); *E21B 47/001* (2020.05)

(58) Field of Classification Search

CPC .. E21B 33/0355; E21B 47/001; E21B 33/068; E21B 23/08; E21B 41/04

See application file for complete search history.

(56) References Cited

U.S. PATENT DOCUMENTS

| | | | |
|---|---|---|---|
| 1,875,936 | A | 9/1932 | Gordon |
| 2,258,887 | A | 10/1941 | Fortune |
| 2,943,682 | A | 7/1960 | Ingram, Jr. |
| 2,968,500 | A | 1/1961 | Scaramucci |
| 2,968,505 | A | 1/1961 | Scaramucci |
| 3,132,867 | A | 5/1964 | Scaramucci |
| 3,145,995 | A | 8/1964 | Adamson |
| 3,168,320 | A | 2/1965 | Sneed |

(Continued)

FOREIGN PATENT DOCUMENTS

| | | | |
|---|---|---|---|
| CA | 2708851 | C | 4/2014 |
| CN | 207974789 | U | 10/2018 |

(Continued)

OTHER PUBLICATIONS

International Search Report and Written Opinion issued in International Patent Appl. No. PCT/US2023/063311 on Jun. 23, 2023; 9 pages.

(Continued)

*Primary Examiner* — Nicole Coy
*Assistant Examiner* — Douglas S Wood
(74) *Attorney, Agent, or Firm* — Jeffrey D. Frantz

(57) ABSTRACT

A well intervention system includes a housing. A first annular packer and a second annular packer are positioned in the housing and are configured to seal against a conduit. A lubricant injection port extends through the housing to a cavity defined between the first annular packer and the second annular packer. A pressure release port extends through the housing to the cavity, and a pressure release valve is configured to be selectively actuated to enable release of pressure from the cavity through the pressure release port.

16 Claims, 3 Drawing Sheets

(56) References Cited

U.S. PATENT DOCUMENTS

| | | | | |
|---|---|---|---|---|
| 3,228,703 | A | 1/1966 | Sneed | |
| 3,265,399 | A | 8/1966 | Wilson | |
| 3,637,009 | A * | 1/1972 | James | E21B 33/076 166/77.1 |
| 4,423,775 | A | 1/1984 | Wilson | |
| 5,579,839 | A | 12/1996 | Culpepper | |
| 5,676,384 | A | 10/1997 | Culpepper | |
| 7,331,393 | B1 * | 2/2008 | Hoel | E21B 33/072 166/336 |
| 8,443,878 | B2 | 5/2013 | McCollin | |
| 8,863,830 | B2 | 10/2014 | Varkey | |
| 9,140,115 | B2 | 9/2015 | Varkey | |
| 9,556,700 | B2 | 1/2017 | Shek | |
| 10,487,616 | B2 | 11/2019 | Varkey | |
| 10,526,863 | B2 | 1/2020 | Gabriele | |
| 10,683,934 | B2 | 6/2020 | Arteaga | |
| 10,968,715 | B2 | 4/2021 | McDaniel | |
| 11,137,109 | B2 * | 10/2021 | Babineaux | F16N 11/08 |
| 2009/0183881 | A1 | 7/2009 | Sbordone | |
| 2010/0258323 | A1 | 10/2010 | Varkey | |
| 2011/0011593 | A1 * | 1/2011 | Borhaug | E21B 7/124 166/311 |
| 2011/0094731 | A1 * | 4/2011 | Crawford | E21B 33/08 166/84.2 |
| 2011/0192610 | A1 * | 8/2011 | Machin | E21B 33/076 166/344 |
| 2012/0024521 | A1 * | 2/2012 | Villa | E21B 33/068 166/75.11 |
| 2012/0292051 | A1 | 11/2012 | Wetzel | |
| 2013/0140042 | A1 | 6/2013 | Benson | |
| 2013/0161019 | A1 * | 6/2013 | Organ | E21B 41/00 184/12 |
| 2020/0309265 | A1 | 10/2020 | Arteaga | |

FOREIGN PATENT DOCUMENTS

| | | | |
|---|---|---|---|
| FR | 2466684 | A1 | 4/1981 |
| GB | 2433283 | A | 6/2007 |
| WO | 2009074780 | A2 | 6/2009 |
| WO | 2023168198 | A1 | 9/2023 |
| WO | 2024072770 | A1 | 4/2024 |
| WO | 2024072776 | A1 | 4/2024 |
| WO | 2024123587 | A1 | 6/2024 |

OTHER PUBLICATIONS

Combined Search and Exam Report issued in Great Britain Patent Application No. GB2409782.6 dated Dec. 31, 2024, 5 pages.

Oxford Languages. (2005). Flat. Retrieved from https://www.google.com on May 1, 2025 (Year: 2025); 1 page.

* cited by examiner

PRESSURE RELEASE SYSTEM FOR WELL INTERVENTION

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below a surface of the earth, drilling systems are often employed to carry out drilling operations to access the desired resource. The drilling systems generally include a wellhead assembly mounted above a wellbore of a well. Additionally, at various times, a well intervention system (e.g., a pressure control equipment [PCE] stack) may be mounted to the wellhead assembly to carry out well intervention operations to inspect or to service the well. The well intervention system may include a well control valve, a lubricator assembly, and/or a pressure control system stacked above the wellhead assembly to facilitate the well intervention operations and to protect other well equipment and/or an environment from surges in pressure within the wellbore.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a well intervention system includes a housing. A first annular packer and a second annular packer are positioned in the housing and are configured to seal against a conduit. A lubricant injection port extends through the housing to a cavity defined between the first annular packer and the second annular packer. A pressure release port extends through the housing to the cavity, and a pressure release valve is configured to be selectively actuated to enable release of pressure from the cavity through the pressure release port.

In certain embodiments, a pressure control system for a subsea well intervention system includes a housing. A first annular packer and a second annular packer are positioned in the housing and are configured to seal against a conduit. A pressure release port extends through the housing to a cavity defined between the first annular packer and the second annular packer. A pressure release valve is configured to be selectively actuated to enable release of pressure from the cavity through the pressure release port. A lubricant return line is coupled to the pressure release port and is configured to receive fluids from the cavity via the pressure release port.

In certain embodiments, a method of operating a well intervention system includes monitoring a tension of a conduit during a well intervention operation, comparing the tension of the conduit to a tension threshold, and in response to the tension of the conduit failing to correspond to the tension threshold, providing a flow of hydraulic fluid to a pressure release valve to release pressure from a cavity defined between annular packers.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
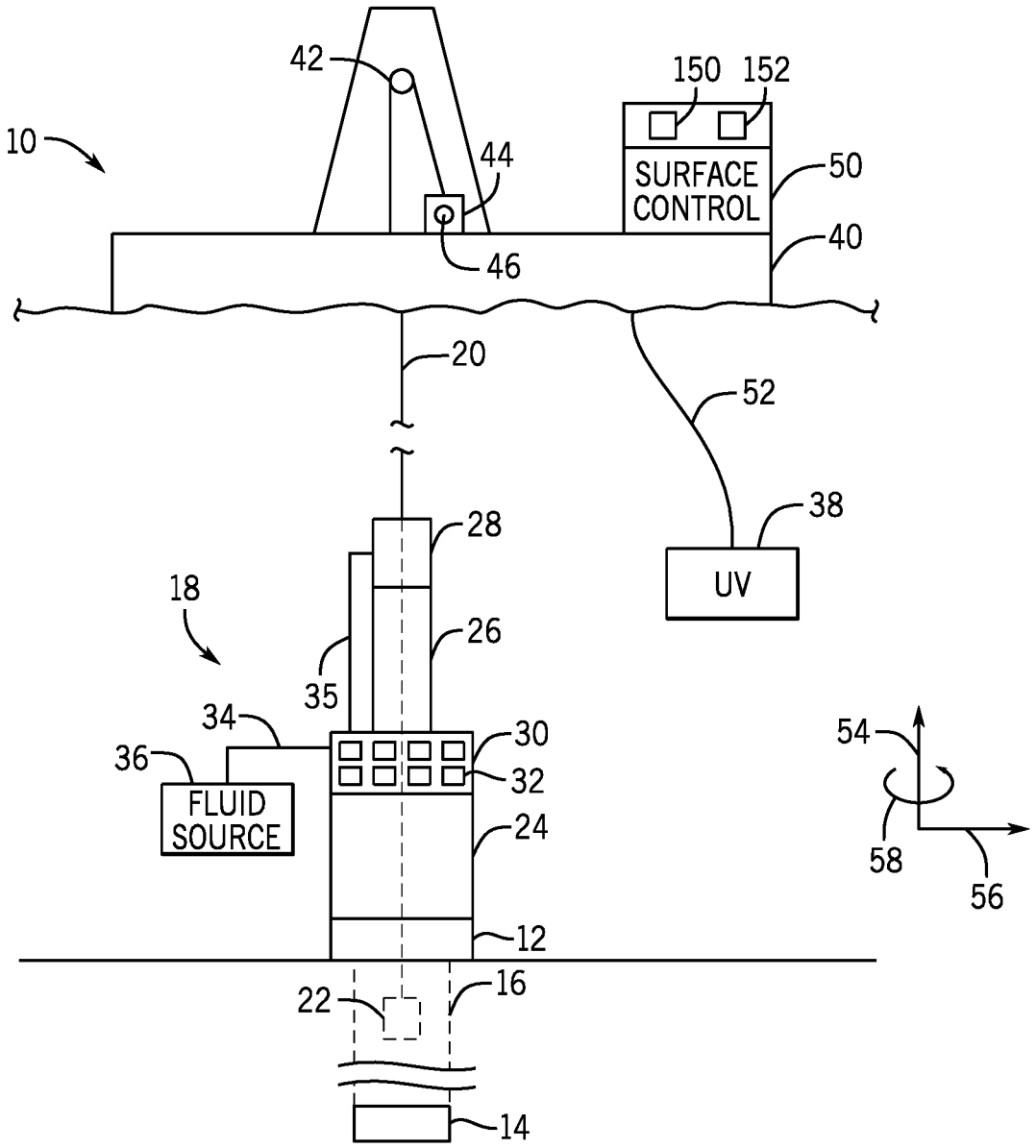
FIG. 1 is a schematic diagram of a system having a well intervention system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A well intervention system (e.g., pressure control equipment [PCE] stack) is utilized to perform well intervention operations (e.g., inspection or service operations), such as operations in which a tool supported on a cable is lowered through a series of components of the well intervention system to enable inspection and/or maintenance of a well. The series of components may be arranged in a stack and may include a well control valve, a lubricator assembly, and/or a pressure control system. For example, the well control valve may include or be a blowout preventer (BOP), the lubricator assembly may include or be a series of tubulars, and the pressure control system may include or be an annular seal system (e.g., stuffing box) with annular packers (e.g., seal elements).

During the well intervention operations, at least one of the annular packers seals against the cable to form a seal (e.g., annular seal) about the cable. It is presently recognized that it would be desirable to provide a pressure release system that may be part of and/or used with the pressure control system. As disclosed herein, the pressure release system may include a pressure release valve that may be opened to release pressure from a cavity (e.g., volume or space) defined or positioned between the annular packers.

The pressure release system may be designed for efficient, effective pressure release operations in subsea environments. In particular, the pressure release valve may be hydraulically actuated via a flow of hydraulic fluid. Further, in certain embodiments, the pressure release valve may be hydraulically actuated by temporarily rerouting (e.g., switching, such as via an electronic controller and/or manipulation by an unmanned vehicle) the flow of hydraulic fluid from another component (e.g., head catcher; lubricant injection ports; the flow of hydraulic fluid is not available to actuate the another component) to the pressure release valve (e.g., the flow of hydraulic fluid is available to actuate the pressure release valve). In this way, the pressure release system may utilize existing hydraulic control lines (e.g., hydraulic conduits) and/or be operable without dedicated hydraulic control components (e.g., pumps, outlets, and/or lines), which may provide cost savings, space savings, and so forth.

As described herein, the pressure release system includes certain features that may be particularly useful in the subsea environment and that may address particular challenges in the subsea environment. For example, in the subsea environment, there is limited or no access for manual actuation of valves (e.g., hand-operated valves; manual actuation by human operators), limited hydraulic control lines, limited space to add hydraulic control lines, long vertical distances, and/or limited access to volumes between annular packers for direct pressure measurements. However, it should be appreciated that the pressure release system may be adapted for use in surface systems (e.g., land-based systems).

Further, while present embodiments are described with reference to a cable, it should be appreciated that the pressure release system may be adapted for use with any of a variety of tubular or cylindrical structures (e.g., conduits), such as a wireline, jacketed cable (e.g., StreamLINE™ cable), slickline, coiled tubing, and/or other spoolable rod. Furthermore, while the disclosed embodiments illustrate and describe the pressure release system in the context of well intervention operations, it should be understood that the pressure release system may be adapted for use in other contexts and during other operations (e.g., drilling operations).

With the foregoing in mind, FIG. 1 is a schematic diagram of an embodiment of a system 10 (e.g., subsea system). The system 10 includes a wellhead 12, which is coupled to a mineral deposit 14 via a wellbore 16. A well intervention system 18 (e.g., PCE stack) is coupled to the wellhead 12 to facilitate well intervention operations, which may be carried out by lowering a cable 20 and/or a tool 22 (e.g., configured to collect data about the mineral deposit 14 and/or the wellbore 16) through a bore defined by a series of components of the well intervention system 18, through a wellhead bore of the wellhead 12, and into the wellbore 16.

The series of components of the well intervention system 18 may be arranged in a stack (e.g., coaxial; stacked vertically above the wellhead 12 and the wellbore 16) and may include a well control valve 24, a lubricator assembly 26, and/or a pressure control system 28. For example, the well control valve 24 may include or be a BOP, the lubricator assembly 26 may include or be a series of tubulars, and the pressure control system 28 may include or be an annular seal system (e.g., stuffing box) with annular packers (e.g., seal elements).

The well intervention system 18 may also include a control panel 30 (e.g., subsea control system) that includes one or more switches 32 (e.g., input devices). It should be appreciated that the one or more switches 32 may be any type of mechanical and/or electrical input devices. While the one or more switches 32 are illustrated between the well control valve 24 and the lubricator assembly 26, it should be appreciated that the one or more switches 32 may be located at any suitable position within the well intervention system 18 (e.g., at or along the lubricator assembly 26 and/or pressure control system 28). One or more conduits 34 (e.g., hydraulic conduits) are configured to provide hydraulic fluid from a fluid source 36 to the well intervention system 18 (e.g., to a manifold of the well intervention system 18). Additionally, one or more hydraulic control lines 35 (e.g., hydraulic conduits) are configured to provide a flow of the hydraulic fluid to control individual controllable elements of the well intervention system 18 (e.g., from the manifold to control the individual controllable elements of the well intervention system 18), such as to control individual controllable elements of the pressure control system 28 (e.g., the annular packers, a head catcher, valves).

As discussed herein, at least one of the one or more hydraulic control lines 35 may be configured to direct the flow of hydraulic fluid to a pressure release system associated with the pressure control system 28. Further, in certain embodiments, at least one of the one or more switches 32 may be adjusted (e.g., temporarily adjusted; from a first position [first position, command, or input] to a second position [second position, command, or input]) to enable the at least one of the one or more hydraulic control lines 35 to direct the flow of hydraulic fluid to the pressure release system associated with the pressure control system 28. In certain embodiments, the at least one of the one or more switches 32 may be adjusted via an unmanned vehicle 38 (e.g., remotely operated vehicle [ROV] or autonomous underwater vehicle [AUV]). For example, the unmanned vehicle 38 may be instructed to move toward and manipulate the at least one of the one or more switches 32 (e.g., from the first position to the second position).

The system 10 may also include a surface vessel 40 (e.g., floating platform or vessel at a sea surface). As shown, the cable 20 may extend from the pressure control system 28, over a sheave 42 supported on the surface vessel 40, and to a winch 44 supported on the surface vessel 40. In operation, rotation of the winch 44 (e.g., a drum or spool of the winch 44) raises and lowers the cable 20 with the tool 22 through the pressure control system 28 and other components in the series of components of the well intervention system 18. In certain embodiments, a sensor 46 (e.g., tension meter) is positioned to measure a tension of the cable 20. As discussed herein, the tension is indicative of friction on the cable 20, such as friction on the cable 20 due to the annular packers of the annular seal system of the pressure control system 28.

In certain embodiments, a surface control system 50 may be configured to process sensor data from the sensor 46 (e.g., to determine the tension and/or to determine that the tension does not correspond to a tension threshold), provide control signals to the winch 44 (e.g., to rotate the drum or spool of the winch 44), provide control signals via the cable 20 to operate the tool 22, provide control signals to operate the unmanned vehicle 38 (e.g., via a control cable 52), and/or provide data to other components of the system 10 (e.g., to the unmanned vehicle 38, such as via the control cable 52; and/or to the control panel 30, such as via data umbilicals), for example.

As discussed in more detail herein, the pressure control system 28 may include the annular seal system with the annular packers. During the well intervention operations, the annular packers are configured to seal against the cable 20 to form a seal (e.g., annular seal) about the cable 20. In this way, the annular packers seal an annular space about the cable 20 to block a flow of wellbore fluid across the annular seal system (e.g., within the bore of the well intervention system 18; from a first location vertically below the annular seal system to a second location vertically above the annular seal system) and to thereby isolate the environment, as well as other equipment, from pressurized fluid within the wellbore 16. To facilitate discussion, the system 10 and its components (e.g., the pressure control system 28) may be described with reference to a vertical axis or direction 54, a lateral or radial axis or direction 56, and/or a circumferential axis or direction 58.

Figure 2:
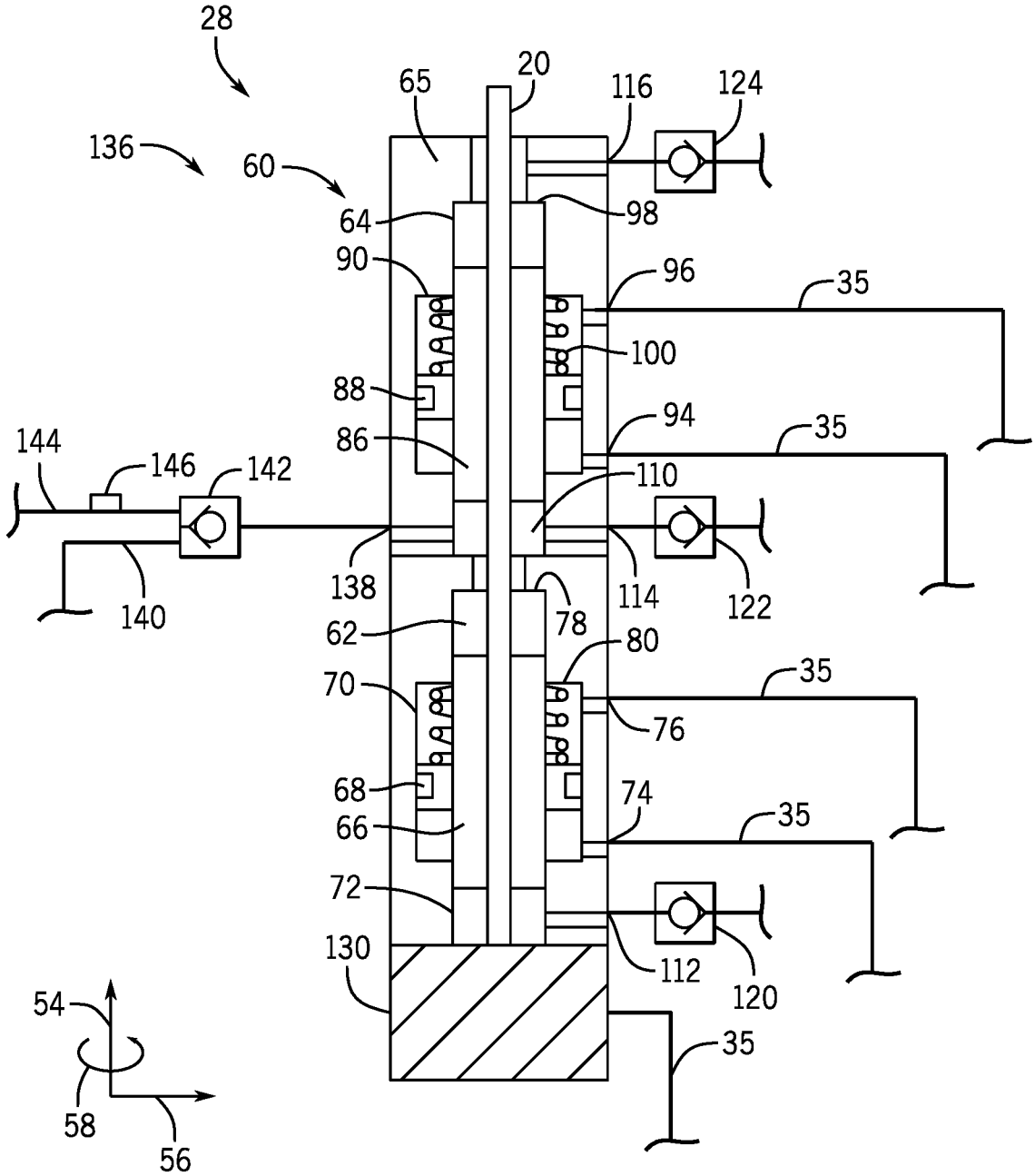
FIG. 2 is a cross-sectional side view of an annular seal system that may be utilized in the well intervention system of FIG. 1, in accordance with an embodiment of the present disclosure.

FIG. 2 is a cross-sectional side view of an annular seal system 60 that may be utilized in the pressure control system 28. As shown, the annular seal system 60 includes the annular packers (e.g., elastomer annular packers), referred to herein as a first annular packer 62 (e.g., lower packer) and a second annular packer 64 (e.g., upper packer). The first annular packer 62 and the second annular packer 64 are coaxial and stacked relative to one another along the vertical axis 54. The first annular packer 62 and the second annular packer 64 are positioned within a housing 65. The first annular packer 62 and the second annular packer 64 are configured to seal against the cable 20, while enabling the cable 20 to move through (e.g., slide along the vertical axis 54; raise and lower along the vertical axis 54) the first annular packer 62 and the second annular packer 64.

As shown, the first annular packer 62 is coupled to and/or supported on a first annular support structure 66. The first annular support structure 66 includes or is coupled to a first annular ring 68 within a first radially-expanded portion 70 of a bore 72 of the pressure control system 28. To enable control of a respective sealing force applied by the first annular packer 62 to the cable 20, the annular seal system 60 may include open/close ports, such as a first close port 74 and a first open port 76.

For example, a flow of hydraulic fluid to the first close port 74 via a respective one of the one or more hydraulic control lines 35 may drive the first annular ring 68 to move toward the first annular packer 62 (e.g., away from the wellbore) within the first radially-expanded portion 70 of the bore 72 of the pressure control system 28, which may cause the first annular support structure 66 to drive the first annular packer 62 against a first shoulder 78 (e.g., annular shoulder). As the first annular packer 62 compresses along the vertical axis 54 (e.g., between the first annular support structure 66 and the first shoulder 78), the first annular packer 62 may expand along the radial axis 56 toward the cable 20 to increase the respective sealing force applied by the first annular packer 62 to the cable 20 (e.g., drive the first annular packer 62 toward a closed or compressed configuration).

However, a flow of hydraulic fluid to the first open port 76 via a respective one of the one or more hydraulic control lines 35 may drive the first annular ring 68 to move away from the first annular packer 62 (e.g., toward the wellbore) within the first radially-expanded portion 70 of the bore 72 of the pressure control system 28, which may reduce compression of the first annular packer 62 between the first annular support structure 66 and the first shoulder 78. As the first annular packer 62 relaxes along the vertical axis 54 (e.g., between the first annular support structure 66 and the first shoulder 78), the first annular packer 62 may expand along the vertical axis 54 and decrease the respective sealing force applied by the first annular packer 62 to the cable 20 (e.g., drive the first annular packer 62 toward an open or relaxed configuration). A biasing member 80 (e.g., spring) may be provided to bias the first annular ring 68 away from the first annular packer 62 to support the decrease in the respective sealing force applied by the first annular packer 62 to the cable 20 (e.g., drive the first annular packer 62 toward the open or relaxed configuration; to assist with overcoming wellbore pressure).

Similarly, as shown, the second annular packer 64 is coupled to and/or supported on a second annular support structure 86. The second annular support structure 86 includes or is coupled to a second annular ring 88 within a second radially-expanded portion 90 of the bore 72 of the pressure control system 28. To enable control of a respective sealing force applied by the second annular packer 64 to the cable 20, the annular seal system 60 may include open/close ports, such as a second close port 94 and a second open port 96.

For example, a flow of hydraulic fluid to the second close port 94 via a respective one of the one or more hydraulic control lines 35 may drive the second annular ring 88 to move toward the second annular packer 64 (e.g., away from the wellbore) within the second radially-expanded portion 90 of the bore 72 of the pressure control system 28, which may cause the second annular support structure 86 to drive the second annular packer 64 against a second shoulder 98 (e.g., annular shoulder). As the second annular packer 64 compresses along the vertical axis 54 (e.g., between the second annular support structure 86 and the second shoulder 98), the second annular packer 64 may expand along the radial axis 56 toward the cable 20 to increase the respective sealing force applied by the second annular packer 64 to the cable 20 (e.g., drive the second annular packer 64 toward a closed or compressed configuration).

However, a flow of hydraulic fluid to the second open port 96 via a respective one of the one or more hydraulic control lines 35 may drive the second annular ring 88 to move away from the second annular packer 64 (e.g., toward the wellbore) within the second radially-expanded portion 90 of the bore 72 of the pressure control system 28, which may reduce compression of the second annular packer 64 between the second annular support structure 86 and the second shoulder 98. As the second annular packer 64 relaxes along the vertical axis 54 (e.g., between the second annular support structure 86 and the second shoulder 98), the second annular packer 64 may expand along the vertical axis 54 and decrease the respective sealing force applied by the second annular packer 64 to the cable 20 (e.g., drive the second annular packer 64 toward an open or relaxed configuration). A biasing member 100 (e.g., spring) may be provided to bias the second annular ring 88 away from the second annular packer 64 to support the decrease in the respective sealing force applied by the second annular packer 64 to the cable 20 (e.g., drive the second annular packer 64 toward the open or relaxed configuration; to assist with overcoming wellbore pressure).

While FIG. 2 illustrates one example of structural features that may provide adjustment to the first annular packer 62 and the second annular packer 64 (e.g., the respective sealing forces), it should be appreciated that the annular seal system 60 may include any of a variety of structural features to provide adjustment to the first annular packer 62 and the second annular packer 64 (e.g., the respective sealing forces). Thus, with reference to the first annular packer 62, more generally it should be appreciated that the respective sealing force applied by the first annular packer 62 to the cable 20 may increase (e.g., until reaching a maximum) in response to increased pressure along or at a respective lower surface of the first annular packer 62 and/or upon decreased pressure along or at a respective upper surface of the first annular packer 62. Further, the respective sealing force applied by the first annular packer 62 to the cable 20 may decrease (e.g., only until reaching a nonzero minimum; until no force/contact) in response to decreased pressure along or at the respective lower surface of the first annular packer 62 and/or upon increased pressure along or at the respective upper surface of the first annular packer 62. Thus, the respective sealing force applied by the first annular packer 62 to the cable 20 varies based on a pressure differential across the first annular packer 62.

Similarly, with reference to the second annular packer 64, more generally it should be appreciated that the respective sealing force applied by the second annular packer 64 to the cable 20 may increase (e.g., until reaching a maximum) in response to increased pressure along or at a respective lower surface of the second annular packer 64 and/or upon decreased pressure along or at a respective upper surface of the second annular packer 64. Further, the respective sealing force applied by the second annular packer 64 to the cable 20 may decrease (e.g., only until reaching a nonzero minimum; until no force/contact) in response to decreased pressure along or at the respective lower surface of the second annular packer 64 and/or upon increased pressure along or at the respective upper surface of the second annular packer 64. Thus, the respective sealing force applied by the second annular packer 64 to the cable 20 varies based on a pressure differential across the second annular packer 64.

During the well intervention operations, often the wellbore pressure provides a relatively high pressure along or at the respective lower surface of the first annular packer 62 (e.g., greater than pressure at the respective upper surface of the first annular packer 62). Accordingly, the first annular packer 62 may be in the closed or compressed configuration in which the first annular packer 62 blocks a flow of wellbore fluid across the first annular packer 62. In this way, the first annular packer 62 may essentially provide an automatic sealing operation as the respective sealing force between the first annular packer 62 against the cable 20 increases in response to (e.g., with) increases in the wellbore pressure.

Further, none or only some of the flow of wellbore fluid (e.g., a small volume of the wellbore fluid) may reach a cavity 110 (e.g., volume or space) within the bore 72 and defined between the first annular packer 62 and the second annular packer 64 along the vertical axis 54. For example, during acceptable and/or expected operation of the annular seal system 60, the absence of the wellbore fluid or the small volume of the wellbore fluid in the cavity 110 may enable the second annular packer 64 to remain in the open or relaxed configuration. As such, the respective sealing force applied by the second annular packer 64 to the cable 20 (if any) may enable the cable 20 to move freely or create acceptable and/or expected friction (e.g., no contact or friction; low friction) between the second annular packer 64 and the cable 20.

However, the second annular packer 64 may operate as a backup seal to essentially provide an automatic backup sealing operation should the first annular packer 62 permit more of the flow of wellbore fluid into the cavity 110 (e.g., sufficient to move the second annular packer 64 to the closed or compressed configuration; due to a leak at and/or failure of the first annular packer 62). Further, as described herein, the first close port 74, the first open port 76, the second close port 94, and the second open port 96 may enable additional control and/or adjustment to the first annular packer 62 and/or the second annular packer 64, such as to move the second annular packer 64 to the closed or compressed configuration for certain portions of the well intervention operations, for example. Further, it should be appreciated that the first radially-expanded portion 70 and/or the second radially-expanded portion of the bore 72 may operate as an accumulator tank with a gas (e.g., nitrogen and/or helium gas) to aid in moving the first annular ring 68 and/or the second annular ring 88. In such cases, a gas charge valve may be utilized rather than a dedicated hydraulic function and a biasing member (e.g., instead of the first close port 74 with the first biasing member 80 and/or the second close port 94 with the second biasing member 100).

Additionally, the pressure control system 28 may include multiple lubricant ports, such as a first lubricant injection port 112 (e.g., a lower port), a second lubricant injection port 114 (e.g., a middle port), and a third lubricant injection port 116 (e.g., an upper port). The lubricant injection ports 112, 114, 116 may enable injection of lubricant into the bore 72 to lubricate the cable 20 (e.g., between the cable 20 and contact surfaces of the pressure control system 28 that contact the cable 20). Thus, the lubricant may reduce friction and facilitate movement of the cable 20, which in turn may reduce wear on the cable 20 and the contact surfaces of the pressure control system 28 that contact the cable 20.

In certain embodiments, the lubricant is injected adjacent to an energized annular packer (e.g., in the closed or compressed configuration) and/or based on a direction of movement of the cable 20. For example, while the cable 20 is being lowered toward the wellbore with the first annular packer 62 in the closed or compressed configuration, the lubricant may be provided via at least the second lubricant injection port 114. However, while the cable 20 is being withdrawn from the wellbore with the first annular packer 62 in the closed or compressed configuration, the lubricant may be provided via at least the first lubricant injection port 112.

It should be appreciated that the lubricant injection ports 112, 114, 116 may include respective valves 120, 122, 124 (e.g., check valves; hydraulically actuated one-way valves; enable flow of the lubricant from a lubricant source, through respective lubricant lines, and to the lubricant injection ports 112, 114, 116 as long as the lubricant is pumped at a pressure that is sufficient for the respective valves 120, 122, 124) that enable delivery of the lubricant into the bore 72 and that block drainage of the lubricant from the bore 72. The delivery of the hydraulic fluid to the first close port 74, the first open port 76, the second close port 94, the second open port 96, and the lubricant injection ports 112, 114, 116 may be controlled (e.g., instructed) via any suitable control system, including the control panel 30, the unmanned vehicle 38, and/or the surface control system 50 of FIG. 1 based on any of a variety of inputs (e.g., sensor data; control signals; programmed settings for different stages of the well intervention operations) and/or via appropriate communication connections (e.g., umbilicals).

It is presently recognized that, at least occasionally and/or under certain conditions, pressure within the cavity 110 may reach unacceptable or undesirable levels (e.g., meet or exceed a pressure threshold; 500, 1000, 1500, or 2000 pounds per square inch [PSI]), such that the pressure within the cavity 110 drives the second annular packer 64 against the cable 20 to cause unacceptable or undesirable sealing force applied by the second annular packer 64 to the cable 20, causes unacceptable or undesirable friction between the second annular packer 64 and the cable 20, and/or causes unacceptable or undesirable wear on the second annular packer 64 and/or the cable 20, and so forth. The pressure within the cavity 110 may meet or exceed the pressure threshold for any of a variety of reasons, such as due to a delay in sufficient sealing force applied by the first annular packer 62 after initiating a pressure test and/or due to a temporary insufficient seal (e.g., leak) at the first annular packer 62.

Any of a variety of sensors may be utilized to monitor the pressure within the cavity 110, and then sensor data may be utilized to determine that the pressure within the cavity 110 may have reached unacceptable or undesirable levels. For example, the sensor 46 in FIG. 1 may be provided to measure the tension of the cable 20, which is indicative of and/or is caused at least in part by friction on the cable 20, such as friction on the cable 20 due to contact with the first annular packer 62 and/or the second annular packer 64. The tension of the cable 20 may be expected to remain within certain parameters during the well intervention operations (e.g., correspond to the tension threshold, which may be a range and/or may vary over time based on a particular stage of the well intervention operations, equipment characteristics, well conditions, and/or environmental conditions; the tension threshold may be based on empirical data and/or modeled tension). Thus, the tension of the cable 20 may be monitored as the cable 20 is lowered toward the wellbore 16 and as the cable 20 is withdrawn away from the wellbore 16. Further, this may provide or generate a trend in the tension of the cable 20 over time.

In certain embodiments, the surface control system 50 may receive the sensor data, process the sensor data to determine the tension on the cable 20, and compare the tension on the cable 20 to the tension threshold. In response to the sensor data from the sensor 46 indicating that the tension of the cable 20 does not correspond to the tension threshold (or is otherwise an indicator of pressure in the cavity 110, such as a slow increase in the trend in the tension of the cable 20 over time) and thus does not correspond to expected values during the well intervention operations, the surface control system 50 may determine possible occurrence of excess friction on the cable 20 due to unexpected contact with the second annular packer 64 and/or instruct actions to relieve any pressure that may be within the cavity 110. Thus, because one possible cause of the tension on the cable 20 failing to correspond to the tension threshold is that the pressure within the cavity 110 has reached unacceptable or undesirable levels, the surface control system 50 may instruct the actions to relieve any pressure that may be within the cavity 110 in an attempt to return the tension on the cable 20 to a value that corresponds to the tension threshold.

As noted herein, any of a variety of other types of sensors may be utilized to monitor the pressure within the cavity 110. For example, a wireless sensor (e.g., pressure sensor) positioned within the cavity 110 (e.g., capable of wirelessly communicating sensor data through the housing 65 of the annular seal system 60 to a receiver positioned outside of the housing 65 of the annular seal system 60) may be utilized to monitor the pressure within the cavity 110. As another example, a visual and/or mechanical sensor that extends radially through the housing 65 of the annular seal system 60 (e.g., makes a change in configuration in response to the pressure within the cavity 110 exceeding the pressure threshold so as to be visible or detectable by a detector outside of the housing 65 of the annular seal system 60, such as a camera coupled to the annular seal system 60, a camera of the unmanned vehicle 38 of FIG. 1, and/or a mechanical switch that is triggered by the change in the configuration). While certain examples of components and techniques to monitor the pressure within the cavity 110 are described herein to facilitate discussion, it should be appreciated that any of a variety of components and techniques to monitor (directly and/or indirectly) the pressure within the cavity 110 are envisioned and may be utilized to prompt (e.g., trigger) the actions to relieve any pressure that may be within the cavity 110.

With the foregoing in mind, in response to the sensor data indicating that the pressure within the cavity 110 has reached unacceptable or undesirable levels and/or at any other suitable time (e.g., periodically during the well intervention operations; periodically during stages of the well intervention operations in which another component, such as one of the lubricant injection ports 112, 114, 116, or a head catcher 130, of the pressure control system 28 is not utilized; following a pressure test), it may be desirable to efficiently release pressure within the cavity 110. To facilitate the release of the pressure from the cavity 110, the annular seal system 60 includes a pressure release system 136 with a pressure release port 138, a pressure release control line 140, a pressure release control valve 142 (e.g., pilot valve; pilot operated pressure relief valve), and a lubricant return line 144. A pressure sensor 146 may be positioned along the lubricant return line 144 (e.g., outside of the pressure release control valve 142) to enable a pressure reading (e.g., to confirm presence of excessive pressure within the cavity 110; to confirm whether the pressure within the cavity 110 did or did not exceed the threshold pressure).

In operation, a flow of hydraulic fluid is provided through the pressure release control line 140 to adjust the pressure release control valve 142 from a closed position to an open position. While the pressure release control valve 142 is in the open position, the pressure within the cavity 110 may release (e.g., escape, relieve) through the pressure release port 138 and the lubricant return line 144. The lubricant return line 144 may accept or receive any fluids trapped within the cavity 110 as the pressure is released from the cavity 110 through the pressure release port 138 and the lubricant return line 144. Thus, the lubricant return line 144 may be rated to contain the pressure up to the wellbore pressure. In some embodiments, the lubricant return line 144 may direct the fluids from the cavity 110 to a container (e.g., storage and/or recycling container of a processing system; at a sea floor; capable of being retrieved or carried to the surface vessel 40 of FIG. 1) or otherwise dispose of the fluids in an appropriate manner (e.g., drain to an environment).

In certain embodiments, the pressure release control line 140 may couple (e.g., directly) to the second open port 96. In such cases, the flow of hydraulic fluid provided through the pressure release control line 140 to release the pressure within the cavity 110 through (e.g., across) the second annular packer 64. It should also be appreciated that the pressure release control valve 142 may be any suitable type of valve, including a fluid-actuated valve, an electrically-actuated valve (e.g., solenoid), and so forth. Further, while two annular packers (e.g., the first annular packer 62 and the second annular packer 64) are shown in FIG. 2 to facilitate discussion, it should be appreciated that the annular seal system 60 may include any number of annular packers (e.g., three, four, or more). In such cases, the pressure release system 136 may include multiple pressure release ports 138, one or more pressure release control lines 140, one or more pressure release control valves 142, and one or more lubricant return lines 144 to release the pressure from each of the cavities defined between the annular packers (e.g., multiple cavities, wherein each cavity of the multiple cavities is defined between a respective pair of adjacent annular packers; two cavities and three annular packers). In certain embodiments, a single pressure release control valve 142 may be coupled to the multiple pressure release ports 138 to enable simultaneous release of pressure from the multiple cavities.

As described herein, control capabilities and features provided by the system 10 support and enable the efficient release of the pressure within the cavity 110. In certain embodiments, the pressure release control line 140 and the pressure release control valve 142 may be separately coupled to the fluid source 36 (e.g., via a dedicated outlet of the manifold). Thus, in some such cases, control signals generated by the control panel 30 may cause the flow of hydraulic fluid through the pressure release control line 140 to actuate the pressure release control valve 142 (e.g., to open the pressure release control valve 142).

However, in some embodiments, the pressure release control line 140 and/or the pressure release control valve 142 may not be separately coupled to the fluid source 36 (e.g., may not have a dedicated outlet of the manifold; may share an outlet of the manifold with another component of the well intervention system 18; have certain times during the well intervention operations in which the flow of hydraulic fluid is not available or connected to the pressure release control line 140). For example, in certain embodiments, the system 10 may include a number of hydraulic control lines 35 (e.g., 6, 7, 8, 9, or 10; less than 10, 11, or 12). The system 10 may also include a number of outlets of the manifold (e.g., 6, 7, 8, 9, or 10; less than 10, 11, or 12; each of the outlets of the manifold may have an associated valve, such as an adjustable valve or an on/off valve to provide or to block the flow of hydraulic fluid). The system 10 may also include a number of switches 32 on the control panel 30 (e.g., one switch 32 may be capable of connecting one outlet of the manifold to one or more of the one or more hydraulic control lines 35, such as to provide fluid pressure through a particular open or close port, to the head catcher, and so forth; as discussed herein, at least one switch 32 may be capable of connecting one outlet of the manifold to one or more of the one or more hydraulic control lines 35 and to the pressure release control line 140).

Further, at least some of the hydraulic control lines 35 may provide variable supply pressure (e.g., over a range, such as 0 to 3000 pounds per square inch [PSI] or 0 to 20000 kilopascals [kPa]) and/or at least some of the hydraulic control lines 35 may provide on/off supply pressure (e.g., either 0 or 3000 PSI; either 0 or 20000 kPa). The hydraulic control lines 35 may be connected to the fluid source 36 (e.g., via the manifold) and distributed circumferentially about a portion of the well intervention system 18 (e.g., extending vertically through annular flanges and/or annular bodies of components of the portion of the well intervention system 18). Accordingly, the number of hydraulic control lines 35 may be limited (e.g., due to lack of space for additional hydraulic control lines and/or due to manufacturing costs and/or due to desire to use existing parts without structural modifications).

Advantageously, in some embodiments, the pressure release system 136 may share hydraulic control components (e.g., pumps, outlets, and/or lines) with another component of the well intervention system 18 (e.g., another component of the pressure control system 28). To implement these features, at least one of the one or more switches 32 may be adjustable to direct the flow of hydraulic fluid to the pressure release system 136 (e.g., over a first period of time during the well intervention operations), and then the one or more switches 32 may be adjustable to direct the flow of hydraulic fluid the another component of the well intervention system 18 (e.g., over a second period of time during the well intervention operations).

As described herein, the at least one of the one or more switches 32 may be adjusted via the unmanned vehicle 38. For example, the unmanned vehicle 38 may be instructed to move toward and manipulate the at least one of the one or more switches 32 (e.g., to the first position or to the second position). The unmanned vehicle 38 may be instructed to move toward and manipulate the at least one of the one or more switches 32 via commands (e.g., control signals) from the surface control system 50, such as based on the tension on the cable 20 and/or other sensor data that indicates that the pressure within the cavity 110 may exceed the pressure threshold. In this way, the pressure release control valve 142 may be hydraulically actuated by temporarily rerouting (e.g., switching) the flow of hydraulic fluid from the another component (e.g., one of the lubricant ports 112, 114, 116; the head catcher 130) to the pressure release control valve 142.

The head catcher 130 may be configured to catch a tool head and block movement of the tool head with dogs in a first position, and then providing the flow of hydraulic fluid causes the dogs to move to a second position to release the tool head. However, the head catcher 130 is not utilized when the tool is in the wellbore 16 (or otherwise below the head catcher 130). Accordingly, the at least one of the one or more switches 32 may be adjusted to direct the flow of hydraulic fluid to the pressure release system 136 over the first period of time while the tool is in the wellbore 16 or otherwise below the head catcher 130, and then the at least one of the one or more switches 32 may be adjusted to direct the flow of hydraulic fluid to the head catcher 130 over the second period of time while the tool is above the head catcher 130 (e.g., while it is desirable to have the head catcher 130 ready to release the tool). As noted herein, it should be appreciated that other control techniques may be implemented, including a dedicated hydraulic control pathway for the pressure release control valve 142 and/or actuating the one or more switches 32 via electronic control signals (e.g., instructions or commands; without manipulation by the unmanned vehicle 38).

As shown in FIG. 1, the surface control system 50 includes a processor 150 and a memory device 152. It should be appreciated that the surface control system 50 may be a dedicated control system for the system 10 and/or the surface control system 50 may be part of or include a distributed control system (e.g., remote computing system; cloud computing system) with one or more electronic controllers in communication with one another to carry out the various techniques disclosed herein. The processor 150 may also include one or more processors configured to execute software, such as software for processing signals (e.g., from sensor(s), such as the sensor 46) and/or controlling components of the system 10 (e.g., the winch 44, the unmanned vehicle 38).

The memory device 152 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 152 may store processor-executable instructions (e.g., firmware or software) for the processor 150 to execute, such as instructions for processing signals (e.g., from sensor(s), such as the sensor 46) and/or controlling components of the system 10 (e.g., the winch 44, the unmanned vehicle 38). It should be appreciated that the surface control system 50 may include various other components, such as a communication device that is capable of communicating data or other information (e.g., sensor data; stage of well intervention operations; control signals) to various other devices (e.g., a display system at the surface vessel 40).

Further, while certain operations are described as being performed by the surface control system 50, it should be appreciated that processing and/or control operations may be performed by any suitable device or any suitable combination of devices (e.g., a processor(s) and memory of the control panel 30; a processor(s) and memory of the unmanned vehicle 38; any other processor(s)). For example, the control cable 52 may provide the sensor data from the sensor 46 to the unmanned vehicle 38. In some such cases, a control system of the unmanned vehicle 38 may process the sensor data and determine whether to electrically actuate the one or more switches 32 of the control panel 30 to release the pressure within the cavity 110. As another example, control line umbilicals may extend between the surface control system 50 on the surface vessel 40 and the control panel 30, and the surface control system 50 may send control signals via the control line umbilicals to electrically actuate the one or more switches 32 of the control panel 30. As yet another example, control line umbilicals may extend between the surface vessel 40 and the control panel 30 to provide the sensor data from the sensor 46 to the control panel 30. In some such cases, the control panel 30 may process the sensor data and determine whether to electrically actuate the one or more switches 32 of the control panel 30 to release the pressure within the cavity 110. As yet another example, the control panel 30 may receive the sensor data from another type of sensor located in the subsea environment (e.g., at the annular seal system 60). In some such cases, the control panel 30 may process the sensor data and determine whether to electrically actuate the one or more switches 32 of the control panel 30 to release the pressure within the cavity 110. Indeed, in certain embodiments, collecting the sensor data, processing the sensor data, and/or enabling the flow of hydraulic fluid to the pressure release control valve 142 (e.g., via a dedicated hydraulic control pathway; via actuating the one or more switches 32 of the control panel 30) to release the pressure within the cavity 110 may be carried out in the subsea environment.

Figure 3:
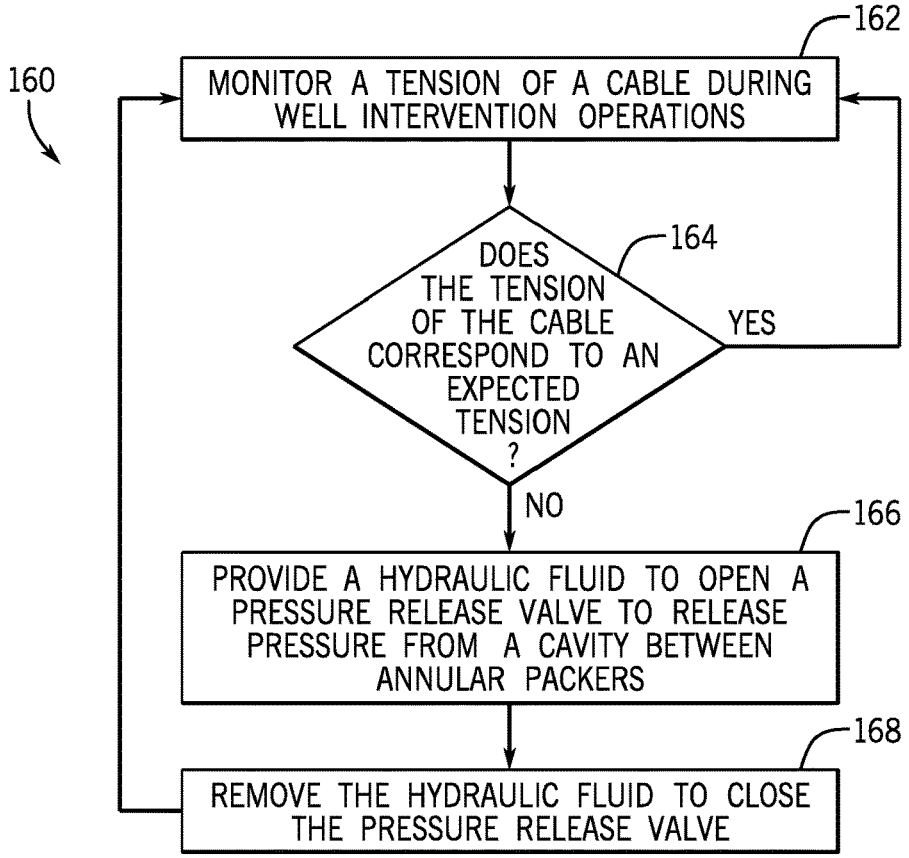
FIG. 3 is a flow diagram of a method of operating a well intervention system to release pressure in a cavity between annular packers, in accordance with an embodiment of the present disclosure.

FIG. 3 is a flow diagram of an embodiment of a method 160 of operating a well intervention system (e.g., the well intervention system 18) to release pressure in a cavity (e.g., the cavity 110) between annular packers (e.g., the first annular packer 62 and the second annular packer 64). It should be appreciated that steps of the method 160 may be performed by a control system (e.g., the control panel 30, the surface control system 50, and/or the unmanned vehicle 38). It should be appreciated that steps may be omitted, steps may be added, and/or steps may be carried out in any suitable order.

In block 162, the method 160 may begin by monitoring a tension of a cable during well intervention operations. For example, a sensor may measure the tension of the cable, which is indicative of and/or is caused at least in part by friction on the cable due to contact with the annular packers. The tension of the cable may be expected to remain within certain parameters during the well intervention operations.

In block 164, the method 160 may continue by processing sensor data to determine the tension on the cable and compare the tension on the cable to a tension threshold (e.g., expected tension). If the tension on the cable corresponds to the tension threshold, the method 160 may return to block 162 to continue with monitoring the tension of the cable during the well intervention operations. However, if the tension on the cable does not correspond to the tension threshold, the method 160 may continue to block 166.

In block 166, the method 160 may continue by providing a flow of hydraulic fluid to open a pressure release valve to release pressure from the cavity between the annular packers. The flow of hydraulic fluid may be routed temporarily (e.g., for a period of time, such as seconds) to release the pressure from the cavity between the annular packers. Then, in block 168, the method 160 may continue by removing the flow of hydraulic fluid to close the pressure release valve. As noted herein, any of a variety of other types of sensors may be utilized to monitor the pressure within the cavity. Thus, block 164 may instead consider other types of sensor data (e.g., pressure; visual and/or mechanical triggers).

As noted herein, any of a variety of other types of sensors and corresponding parameters (e.g., other than the tension of the cable) may be utilized to monitor the pressure within the cavity. For example, a wireless sensor (e.g., pressure sensor) positioned within the cavity (e.g., capable of wirelessly communicating sensor data through a housing to a receiver positioned outside of the housing) may be utilized to monitor the pressure within the cavity. As another example, a visual and/or mechanical sensor that extends radially through the housing may be utilized to provide an indication of the pressure within the cavity. Thus, any of a variety of components and techniques to monitor (directly and/or indirectly) the pressure within the cavity are envisioned and may be utilized to prompt (e.g., trigger) blocks 166 and 168 of the method 160 to relieve any pressure that may be within the cavity.

Accordingly, blocks 162 and 164 of the method 160 may more generally include monitoring a parameter indicative of the pressure within the cavity and then assessing whether the parameter exceeds a respective threshold or otherwise indicates trapped pressure within the cavity. Then, if the parameter does not exceed the respective threshold or otherwise does not indicate the trapped pressure within the cavity, then the method 160 may return to block 162. However, if the parameter exceeds the respective threshold or otherwise indicates the trapped pressure within the cavity, this may prompt (e.g., trigger) blocks 166 and 168 of the method 160 to relieve any pressure that may be within the cavity.

Additionally, it should be appreciated that there may be situations in which it is desirable to relieve any pressure that may be within the cavity even while the tension of the cable corresponds to the expected tension (e.g., with no measurable increase in the tension; with expected tension). For example, if pressure is trapped within the cavity early in the well intervention operations, then the tension of the cable may appear to correspond to the expected tension due to variations and/or inaccuracies in the modeled tension at this stage of the well intervention operations. Accordingly, the stage of the well intervention operations and/or accuracy of the threshold tension may be taken into account in determining the tension threshold and/or in determining whether to open the pressure release valve. Further, the other types of sensors (e.g., pressure gauge within the cavity) and corresponding parameters (e.g., pressure within the cavity) may be utilized alone or in conjunction with the sensor to measure the tension of the cable for reliable, suitable pressure release operations.

Figure 4:
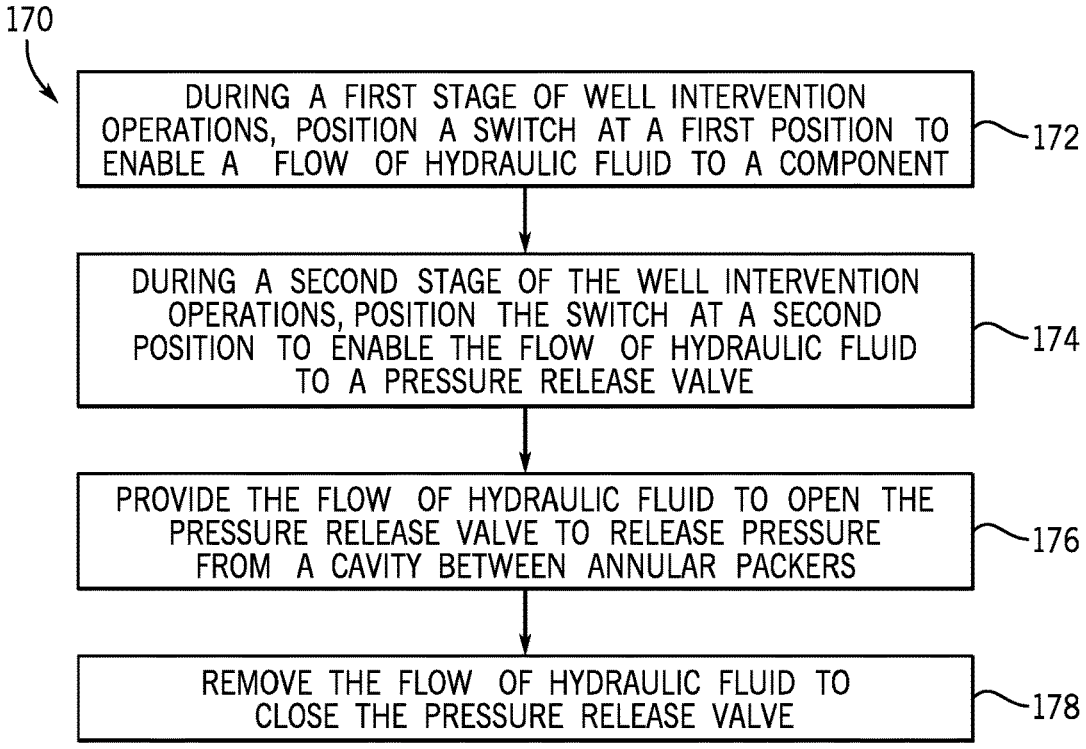
FIG. 4 is a flow diagram of a method of operating a well intervention system to utilize a hydraulic control line for multiple functions, including release of pressure in a cavity between annular packers, in accordance with an embodiment of the present disclosure.

FIG. 4 is a flow diagram of an embodiment of a method 170 of operating a well intervention system (e.g., the well intervention system 18) to utilize hydraulic components (e.g., pumps, outlets, and/or lines) for multiple functions, including release of pressure in a cavity (e.g., the cavity 110) between annular packers (e.g., the first annular packer 62 and the second annular packer 64). It should be appreciated that steps of the method 170 may be performed by a control system (e.g., the control panel 30, the surface control system 50, and/or the unmanned vehicle 38). It should be appreciated that steps may be omitted, steps may be added, and/or steps may be carried out in any suitable order.

In block 172, the method 170 may begin with positioning a switch at a first position to enable a flow of hydraulic fluid to a component (e.g., a port associated with an annular packer; a head catcher) during a first stage of a well intervention operation.

In block 174, the method 170 may continue by positioning the switch at a second position to enable the flow of hydraulic fluid to a pressure release valve during a second stage of the well intervention operation. As described herein, an unmanned vehicle may manipulate the switch to adjust the switch between the first position and the second position. However, other techniques are envisioned, such as electronic control of the switch. Further, while the switch is in the first position, the flow of hydraulic fluid may be blocked from the pressure release valve (e.g., the pressure release valve is isolated from the flow of hydraulic fluid; no hydraulic control pathway to the pressure release valve). Similarly, while the switch is in the second position, the flow of hydraulic fluid may be blocked from the component (e.g., the component is isolated from the flow of hydraulic fluid; no hydraulic control pathway to the component).

In block 176, the method 170 may continue by providing the flow of hydraulic fluid to open the pressure release valve to release pressure from the cavity between the annular packers during the second stage of the well intervention operations. The flow of hydraulic fluid may be routed in response to sensor data that indicates the pressure within the cavity may exceed a threshold pressure. The flow of hydraulic fluid may be routed temporarily (e.g., for a period of time, such as seconds) to release the pressure from the cavity between the annular packers. Then, in block 178, the method 170 may continue by removing the flow of hydraulic fluid to close the pressure release valve during the second stage of the well intervention operations.

It should be appreciated that the method 170 may then return to the first stage of the well intervention operations with the switch at the first position, or the method 170 may remain in the second stage of the well intervention operations with the switch at the second position to enable subsequent (e.g., periodic; in response to the sensor data that indicates the pressure within the cavity may exceed the threshold pressure) pressure release operations as set forth in block 176.

Present embodiments provide a pressure release system that is part of and/or that is used in conjunction with an annular seal system (e.g., stuffing box of a well intervention system). The pressure release system may be configured to release pressure in a cavity between annular packers of the annular seal system under certain conditions (e.g., high pressure conditions, which may be indicated by high tension on a cable that extends through the annular packers of the annular seal system). The pressure release system may include features that facilitate effective, efficient operations in a subsea environment.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims. Any features shown in FIGS. 1-4 or described with reference to FIGS. 1-4 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A well intervention system, comprising:

a housing;

a first annular packer and a second annular packer positioned in the housing and configured to seal against a conduit;

a lubricant injection port that extends through the housing to a cavity defined between the first annular packer and the second annular packer;

a pressure release port that extends through the housing to the cavity;

a pressure release valve configured to be selectively actuated to enable release of pressure from the cavity through the pressure release port, and a switch, wherein actuation of the switch enables a flow of hydraulic fluid to the pressure release valve, wherein the switch in a first position enables the flow of hydraulic fluid to another component, and the switch in a second position enables the flow of hydraulic fluid to the pressure release valve.

2. The well intervention system of claim 1, further comprising:

a lubricator assembly comprising a series of tubulars; and a pressure control system stacked axially relative to the lubricator assembly, wherein the pressure control system comprises the housing, the first annular packer, the second annular packer, the lubricant injection port, the pressure release port, and the pressure release valve.

3. The well intervention system of claim 1, further comprising an unmanned vehicle that is configured to manipulate the switch to cause the actuation of the switch.

4. The well intervention system of claim 1, wherein the another component comprises a first open port for the first annular packer, a first close port for the first annular packer, a second open port for the second annular packer, or a second close port for the second annular packer.

5. The well intervention system of claim 1, wherein the another component comprises a head catcher.

6. The well intervention system of claim 1, further comprising a lubricant return line coupled to the pressure release port and configured to receive fluids from the cavity via the pressure release port.

7. The well intervention system of claim 6, further comprising a pressure sensor along the lubricant return line.

8. The well intervention system of claim 1, further comprising:

a sensor configured to generate sensor data indicative of a pressure within the cavity; and a control system comprising one or more processors, wherein the control system is configured to provide control signals to enable a flow of hydraulic fluid to the pressure release valve to enable release of the pressure from the cavity through the pressure release port based on the sensor data.

9. The well intervention system of claim 8, wherein the sensor comprises a tension sensor that is configured to measure a tension of the conduit.

10. The well intervention system of claim 1, wherein the well intervention system is a subsea well intervention system that is configured to support well intervention operations in a subsea environment.

11. A pressure control system for a subsea well intervention system, the pressure control system comprising:

a housing;

a first annular packer and a second annular packer positioned in the housing and configured to seal against a conduit;

a pressure release port that extends through the housing to a cavity defined between the first annular packer and the second annular packer;

a pressure release valve configured to be selectively actuated to enable release of pressure from the cavity through the pressure release port;

a lubricant return line coupled to the pressure release port and configured to receive fluids from the cavity via the pressure release port, a sensor configured to generate sensor data indicative of a pressure within the cavity; and a control system comprising one or more processors, wherein the control system is configured to:

analyze the sensor data to determine that the pressure within the cavity may be over a pressure threshold; and in response determining that the pressure within the cavity may be over the pressure threshold, provide control signals to enable a flow of hydraulic fluid to the pressure release valve to enable release of the pressure from the cavity through the pressure release port, wherein the sensor comprises a tension sensor that is configured to measure a tension of the conduit.

12. The pressure control system of claim 11, further comprising a switch, wherein actuation of the switch enables a flow of hydraulic fluid to the pressure release valve.

13. The pressure control system of claim 12, wherein the switch in a first position enables the flow of hydraulic fluid to another component, and the switch in a second position enables the flow of hydraulic fluid to the pressure release valve.

14. A method of operating a well intervention system, the method comprising:

monitoring a tension of a conduit during a well intervention operation;

comparing the tension of the conduit to a tension threshold; and in response to the tension of the conduit failing to correspond to the tension threshold, providing a flow of hydraulic fluid to a pressure release valve to release pressure from a cavity defined between annular packers.

15. The method of claim 14, wherein providing the flow of hydraulic fluid to the pressure release valve comprises actuating a switch to enable the flow of hydraulic fluid to the pressure release valve and to block the flow of hydraulic fluid to another component of the well intervention system.

16. The method of claim 14, further comprising providing the flow of hydraulic fluid to the pressure release valve to release the pressure from the cavity via a pressure release port that extends through a housing.

* * * * *